US005957296A

United States Patent [19]

Altenburg et al.

[11] Patent Number: 5,957,296

[45] Date of Patent: Sep. 28, 1999

[54] METHOD AND DEVICE FOR DISTRIBUTING LETTER-POST ITEMS

[75] Inventors: Dieter Altenburg, Allensbach; Hans-Juergen Linde, Coburg; Karl-Heinz Mohr, Untersiemen-Spöppach; Uwe Neumann, Bamberg; Ottmar Kechel, Stockach; Josef Mok; Juergen Penert, both of Konstanz; Torsten Tanz, Singen; Armin Zimmerman, Konstanz, all of Germany

[73] Assignee: Licentia Patent - Verwaltungs GmbH, Frankfurt, Germany

[21] Appl. No.: 08/793,010

[22] PCT Filed: Jun. 5, 1996

[86] PCT No.: PCT/EP96/02440

§ 371 Date: May 27, 1997

§ 102(e) Date: May 27, 1997

[87] PCT Pub. No.: WO96/39262

PCT Pub. Date: Dec. 12, 1996

[30] Foreign Application Priority Data

Jun. 6, 1995 [DE] Germany ..... 195 20 057

[51] Int. Cl.[6] ..... B07C 5/02

[52] U.S. Cl. ..... 209/3.3; 209/584; 209/900

[58] Field of Search ..... 209/584, 583, 209/900, 3.3

[56] References Cited

U.S. PATENT DOCUMENTS

| | | | |
|---|---|---|---|
| 5,042,667 | 8/1991 | Keough | 209/900 X |
| 5,104,681 | 4/1992 | Sansone | 209/584 X |
| 5,292,008 | 3/1994 | Sansone et al. . | |
| 5,421,464 | 6/1995 | Gillmann et al. | 209/584 |
| 5,470,427 | 11/1995 | Mikel et al. | 209/900 X |

FOREIGN PATENT DOCUMENTS

| | | |
|---|---|---|
| 0227569 | 7/1987 | European Pat. Off. . |
| 0586883 | 3/1994 | European Pat. Off. . |
| 0661105 | 7/1995 | European Pat. Off. . |
| 4302231 | 8/1994 | Germany . |

*Primary Examiner*—David H. Bollinger
*Attorney, Agent, or Firm*—Venable; George H. Spencer; Ashley J. Wells

[57] ABSTRACT

A method for distributing letter-post items, for which the letter-post items are separated and the address information affixed to the items is read, provides that for letter-post items belonging to a predetermined sorting class an identification mechanism is assigned to each letter-post item during the reading of the address information in order to mark the position of the assigned letter-post item in a letter-post item stack and that each identification mechanism is assigned to an element for a predetermined sequence of distribution positions and that the assignment of the identification mechanism to the elements of the sequence for the distribution position is displayed.

11 Claims, 2 Drawing Sheets

Figure 1:
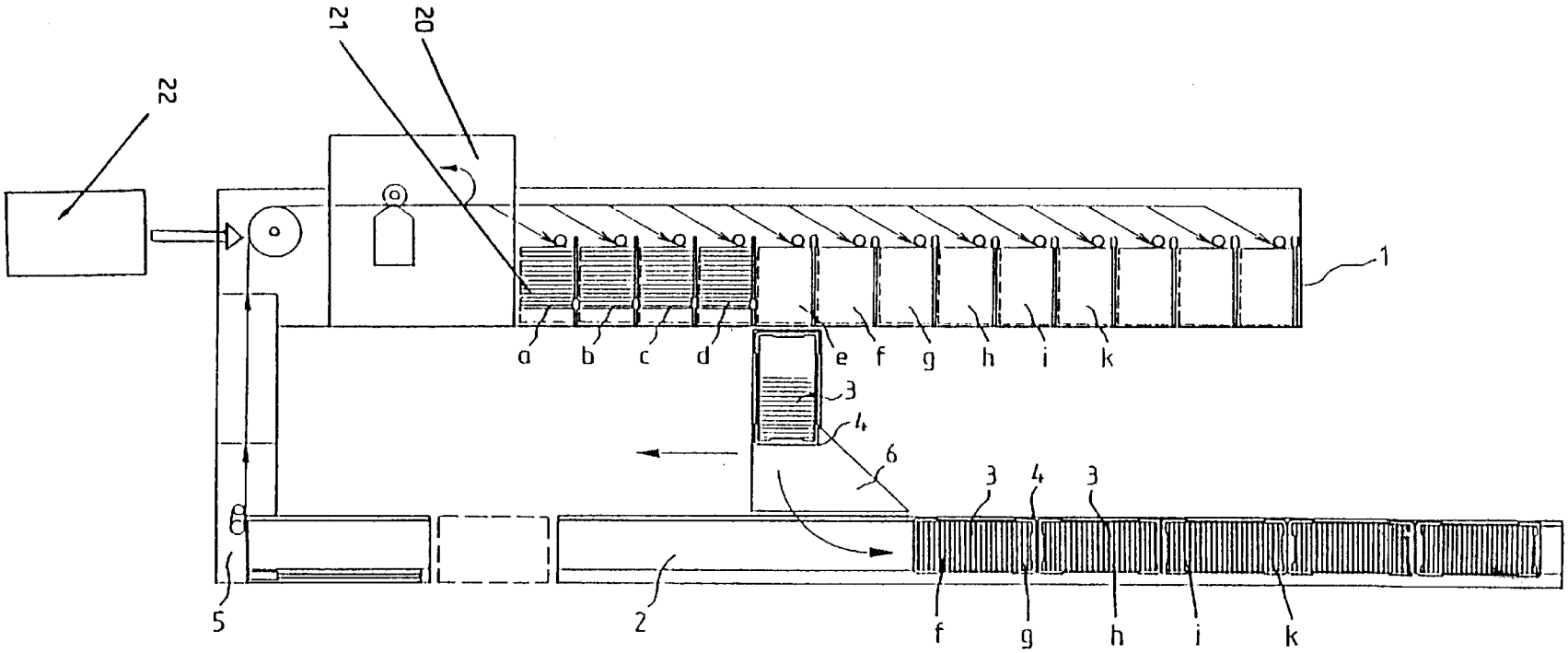

| Stop No. | Letter Positions |
|---|---|
| 1 | 21, 538 |
| 2 | - |
| 3 | 287, 1934, 349, 12 |
| 4 | 737 |
| 5 | - |
| 6 | 367 |
| ... | |

METHOD AND DEVICE FOR DISTRIBUTING LETTER-POST ITEMS

DESCRIPTION

The invention concerns a method and a facility for distributing letter-post items in accordance with the preambles of the independent patent claims.

In letter sorters, the postal goods are sorted in several series-connected sorting processes and are then deposited onto a plurality of stacking surfaces. In this case, it is frequently neither desired nor possible for practical reasons to provide an individual sorting compartment for each smallest class of a sorting operation. For example, if the postal goods are to be sorted according to the sequence of delivery by the mailman, a separate sorting compartment is not used for each mail recipient. Rather, the postal goods are distributed to a specific number of stacking compartments, in the same sequence in which they will later on be distributed by the delivery person during the distribution operation. The postal goods in this case are arranged according to the prescribed sequence within the sorting compartment, so that with a corresponding arrangement of the stacking compartments, the total postal goods are arranged in accordance with the total predetermined sequence. In order to be able to manage with a relatively low number of stacking compartments in sorters, the postal goods are therefore sorted several times and possibly indirectly. A corresponding method is described in the DE-OS 43 02 231. However, for such methods or facilities, where sorting takes place for the smallest and last class of a sorting operation according to the distribution sequence, the number of sorting operations as well as the processing time is higher than for the methods and facilities, for which sorting takes place only to the next to the last class and one is content with the disorderly sequence of letter-post items or postal goods in this next to the last sorting class.

It is the object of the invention at hand to specify a method and a facility, with which the sorting quality is increased, without increasing the number of machine sorting operations and the processing time for the letter-post items through the sorter.

The solution is with the features in the independent patent claims. Advantageous embodiments of the invention follow from the dependent claims, the description, and the drawings.

The invention is based on the fact that for the letter-post items belonging to a predetermined sorting class, each letter-post item is assigned an identification means during the address information reading, which is designed to identify the position of the assigned letter-post items to a letter-post item stack, that each identification means is assigned to an element of a predetermined sequence of distribution positions, and that the assignment of the identification means to the elements of the sequence of distribution positions is displayed. This makes it possible to omit the last machine sorting operation for the letter-post items of the respective sorting class, so that a shortening of the total processing time during the letter sorting is achieved as well. It is advantageous here if the predetermined sequence of distribution positions is arranged according to the distribution sequence for delivering the letter-post items, as well as to print out a list or display the assignment of the identification means to the elements of the sequence for the distribution positions.

It is particularly easy to use as identification means cards made of cardboard or plastic that have either ascending or descending numbers, as well as to arrange a predetermined number of letter-post items together with the corresponding identification means in a stack. The stack is advantageously placed in a container or a pouch carried by the delivery person. The letter-post items are sorted in this way, so that the delivery persons when stopping at the distribution positions remove the letter-post items assigned to these position from the container, wherein the positions of the assigned letter-post items in the stack are indicated by the coordinated identification means.

Figures 2, 3:
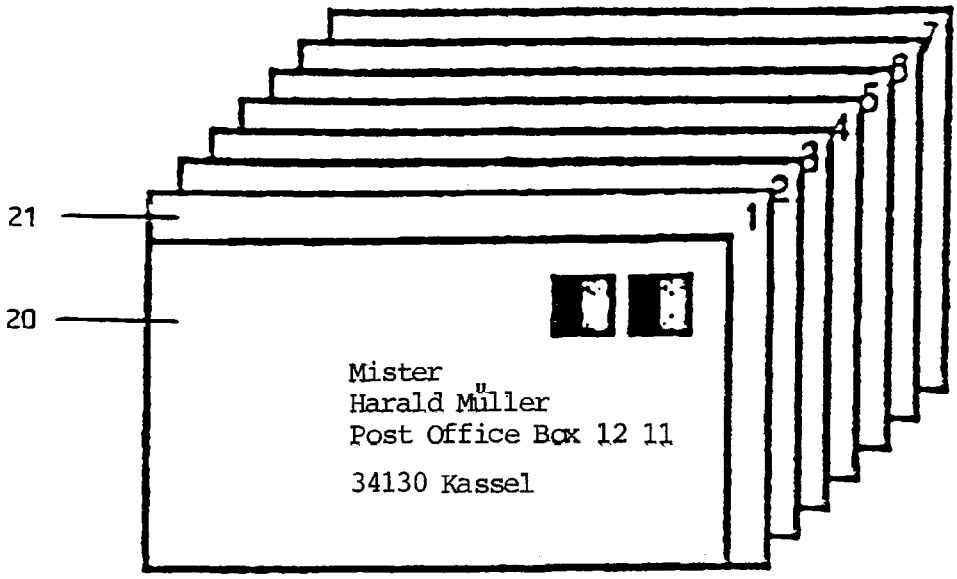

The invention is explained in more detail in the following with the aid of drawings and an exemplary embodiment. Shown here are in:

FIG. 1 A known letter sorter;

FIG. 2 A diagram of a letter-post item stack, together with identification means; and FIG. 3 An example of a list for showing the assignment of the identification means for the elements of the sequence for the distribution position.

FIG. 1 shows a diagram of a letter sorting facility, where a number of stacking compartments 1, which are located opposite a conveyor 2 that was used to fill the letter-post items 3 into transporting containers 4, are transported to the input module 5. A transfer bridge 6 that is positioned between the stacking compartments and the conveyor serves for a fast and safe transfer of the letter-post items from the stacking compartments 1 to the containers 4 and the subsequent transport to the conveyor 2. At the end of each sorting operation, the letter-post items are in the stacking compartments 1 and can be loaded into the transporting containers 4. Completely or partially filled storage containers 4 can be loaded onto a conveyor belt 2 and subsequently transferred to carts for further transport.

For the inventive methods, the letter-post items are generally presorted into sorting classes. On principle, it is also possible to individually separate the letter-post items with subsequent reading of the address and stacking in only one stacking compartment. In that case, the letter-post items are not presorted. The sorting takes place electronically, as described later on. In general, the letter-post items in the last presorted sorting class are not arranged according to the sequence of the distribution positions, meaning in particular that the letter-post items are not arranged in the sequence in which they will later on be delivered by the delivering person during the distribution operation. Each letter-post item is assigned an identification means no later than prior to the last sorting operation in which the letter-post items are sorted into a predetermined sorting class, in order to identify the position of the assigned letter-post item in a letter-post item stack.

For this, the identification means are inserted into the flow of items with a feeding device 22. A suitable device for assigning identification means to each letter-post item is, for example, a dual material inserter, for which an item is pulled alternately from two separate stacks and where the pieces are joined successively for a common transport, as for a zipper.

For this, the address information is used, which is affixed to the consignments and is read in a non-depicted device. The address information can also be affixed in the form of bar code markings to the items.

As a result, the letter-post items together with the assigned identification means are stacked inside a container 4. Each identification means can now be assigned an element of a predetermined sequence of distribution positions, preferably by a data processing unit. The sequence of distribution positions corresponds preferably to the sequence of the distribution during the mail carrier round. An identification of the position of the coordinated letter-post items in the stack occurs through the identification means. A suitable means, e.g. a printed list or a read-out on a display, is used to indicate the assignment of the positions for the letter-post items to the elements in the predetermined sequence of distribution positions.

The stacks of letters provided with the identification means are loaded in containers 4 onto the conveyor belt 2 and are subsequently processed further.

FIG. 2 shows a diagram of a stack of letter-post items provided with identification means. For this embodiment, thin cards of cardboard or plastic with ascending numbers are used as identification means. The card 21 with the designation Number 1 is used for letter-post item 20. It is advantageous if cards with a slightly larger format than that of the average item are used to permit an easy, visual identification of the numbers affixed to the cards.

FIG. 3 shows an example of a list. The elements of the sorting sequence are given in column 1, which are numbered for reasons of simplicity from 1–N (N=5). These sequential elements correspond to the stops made by the delivery person during the distribution round. The stops are assigned to the letter positions in the stack. For example, in FIG. 3 the letter positions 21 and 538 are assigned to stop 1.

No letter position is assigned to stop 2, meaning that no letter-post item to be distributed is present. The four letter-post items with the positions 287, 1934, 349 and 12 are assigned to the stop number 3. As a result of this assignment between the stop numbers and the letter positions, it is very easy for the distributing person during his/her delivery round to identify the letter-post items belonging to the individual distribution positions or stops and remove them from the stack. Thus, the mail carrier sorts the mail by taking the respective letters from their positions during his/her stops.

The letter-post item stacks are advantageously stored in containers, for example box-like containers with rectangular outline or in carrying pouches.

We claim:

1. A method for distributing letter-post items for which the items are separated and the address information affixed to the letters is read, comprising the steps of (a) for letter-post items belonging to a predetermined sorting class, allocating an identification means to each letter during the reading of the address information in order to identify the position of the allocated letter in a stack of letter-post items, (b) allocating each identification means to an element of a given sequence of distribution positions, and (c) indicating the allocation of the identification means to the elements of the sequence of distribution positions.

2. A method according to claim 1, further comprising the step of presorting the letter-post items into predetermined sorting classes.

3. A method according to claim 1, further comprising the step of organizing the predetermined sequence during the delivery of the letter-post items.

4. A method according to claim 3, wherein said identification means are cards made of cardboard or plastic with ascending or descending numbers.

5. A method according to claim 1, further comprising the step of showing the assignment of the identification means to the elements for the sequence of distribution positions in a print list.

6. A method according to claim 1, further comprising the step of showing the assignment of the identification means to the elements for the sequence of distribution positions on a display.

7. A method according to claim 1, wherein a predetermined number of letter-post items are arranged in a stack, together with the corresponding identification means.

8. A method according to claim 7, wherein said stack is in a container.

9. A method according to claim 7, wherein said stack is inside a pouch to be carried by a delivery person.

10. In a letter-post items distributing facility comprising a device for separating items, for reading the address information affixed to the items, and for presorting the items into sorting classes, the improvement comprising a feeding device for assigning numbered cards to the respective items to identify their positions in a stack of such items after the same have been presorted.

11. A facility according to claim 10 wherein said cards are made of cardboard or plastic.

* * * * *